US008765339B2

(12) United States Patent
Wu et al.

(10) Patent No.: US 8,765,339 B2
(45) **Date of Patent: *Jul. 1, 2014**

(54) IMAGING MEMBER LAYERS

(75) Inventors: Jin Wu, Pittsford, NY (US); Kenny-Tuan T. Dinh, Webster, NY (US); Lanhui Zhang, Webster, NY (US); Lin Ma, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/601,456

(22) Filed: Aug. 31, 2012

(65) Prior Publication Data

US 2014/0065533 A1 Mar. 6, 2014

(51) Int. Cl.
*G03G 5/05* (2006.01)

(52) U.S. Cl.
USPC ..... 430/59.6; 430/56.8; 430/96

(58) Field of Classification Search
USPC ..... 430/59.6, 58.8
See application file for complete search history.

(56) References Cited

U.S. PATENT DOCUMENTS

| | | | | |
|---|---|---|---|---|
| 3,121,006 | A | 2/1964 | Middleton | |
| 4,286,033 | A | 8/1981 | Neyhart | |
| 4,291,110 | A | 9/1981 | Lee | |
| 4,338,387 | A | 7/1982 | Hewitt | |
| 4,387,980 | A | 6/1983 | Ueno | |
| 4,464,450 | A | 8/1984 | Teuscher | |
| 4,587,189 | A | 5/1986 | Hor | |
| 4,664,995 | A | 5/1987 | Horgan | |
| 4,792,507 | A * | 12/1988 | Yoshihara et al. | 430/59.6 |
| 4,921,773 | A | 5/1990 | Melnyk | |
| 5,008,706 | A * | 4/1991 | Ohmori et al. | 399/174 |
| 5,215,839 | A | 6/1993 | Yu | |
| 5,281,689 | A * | 1/1994 | Bendler et al. | 528/196 |
| 5,363,176 | A * | 11/1994 | Ishihara et al. | 399/176 |
| 5,660,961 | A | 8/1997 | Yu | |
| 5,756,245 | A | 5/1998 | Esteghamatian | |
| 5,958,638 | A | 9/1999 | Katayama | |
| 6,842,594 | B2 | 1/2005 | Frankel | |
| 8,623,578 | B2 * | 1/2014 | Wu et al. | 430/59.6 |
| 2003/0087171 | A1 * | 5/2003 | Tokutake et al. | 430/58.2 |
| 2007/0019984 | A1 * | 1/2007 | Inagaki et al. | 399/111 |

FOREIGN PATENT DOCUMENTS

| | | | | |
|---|---|---|---|---|
| JP | 07295250 A | * | 11/1995 | G03G 5/05 |

OTHER PUBLICATIONS

English language machine translation of JP 07-295250 (Nov. 1995).*

* cited by examiner

*Primary Examiner* — Christopher Rodee
(74) *Attorney, Agent, or Firm* — Pillsbury Winthrop Shaw Pittman LLP

(57) ABSTRACT

The presently disclosed embodiments relate generally to layers that are useful in imaging apparatus members and components, for use in electrophotographic, including digital printing, apparatuses. More particularly, the embodiments pertain to an improved electrophotographic imaging member comprising a charge transport layer comprising a novel combination of a tetraaryl polycarbonate copolymer binder and perfluorinated fillers. The present charge transport layer provides reduced wear rate and long service life.

20 Claims, 2 Drawing Sheets

IMAGING MEMBER LAYERS

BACKGROUND

The presently disclosed embodiments relate generally to layers that are useful in imaging apparatus members and components, for use in electrophotographic, including digital, apparatuses. More particularly, the embodiments pertain to an improved electrophotographic imaging member comprising a charge transport layer having long service life. The charge transport layer of the present embodiments comprise a novel combination of a binder with perfluorinated fillers.

In electrophotography or electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing or ionographic printing and reproduction where charge is deposited on a charge retentive surface in response to electronically generated or stored images.

To charge the surface of a photoreceptor, a contact type charging device has been used. The contact type charging device includes a conductive member which is supplied a voltage from a power source with a D.C. voltage superimposed with a A.C. voltage of no less than twice the level of the D.C. voltage. The charging device contacts the image bearing member (photoreceptor) surface, which is a member to be charged. The contact type charging device electrostatically charges the image bearing member to a predetermined potential. Typically the contact type charger is in the form of a roll charger such as that disclosed in U.S. Pat. No. 4,387,980, the relative portions thereof incorporated herein by reference. U.S. Pat. No. 6,842,594 describes a contact type charger in the form of a bias charge roll (BCR) member, the relative portions thereof also incorporated herein by reference.

Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrophotographic" includes "electrophotographic" and "xerographic." The terms "charge transport molecule" are generally used interchangeably with the terms "hole transport molecule."

There is a significant need to extend photoreceptor life under bias charge roll (BCR) type charging systems. BCR's typically lead to significantly higher photoreceptor wear than conventional scorotron charging systems and improving the wear resistance of photoreceptors to BCR charging is an area that needs continuous improvement. Photoreceptor surface damage is known to be caused by the flux of charged particles generated in the glow-discharge zone of the BCR. Current conventional photoreceptors used in BCR charging devices can achieve only several ten thousand prints before the photoreceptor is damaged and needs replacement.

Thus, as the demand for improved print quality in xerographic reproduction is increasing, there is a continued need for achieving improved performance, such as finding a way to minimize or eliminate photoreceptor damage and wear, and to increase photoreceptor service life.

SUMMARY

According to aspects illustrated herein, there is provided an imaging member comprising a substrate; an undercoat layer disposed on the substrate; a charge generation layer disposed on the substrate; and a charge transport layer disposed on the charge generation layer, wherein the charge transport layer comprises a tetraaryl polycarbonate and a fluoropolymer filler.

In another embodiment, there is provided an imaging member comprising a substrate; an undercoat layer disposed on the substrate; a charge generation layer disposed on the substrate; and a charge transport layer disposed on the charge generation layer, wherein the charge transport layer comprises a tetraaryl polycarbonate copolymer selected from the group consisting of:

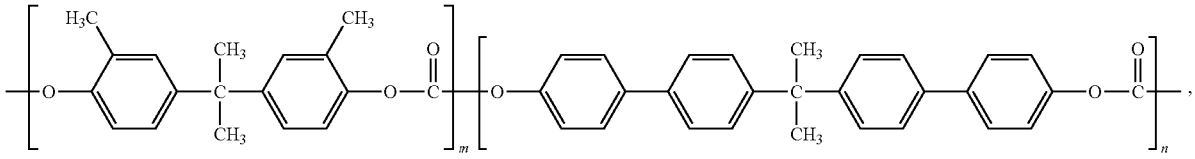

-continued

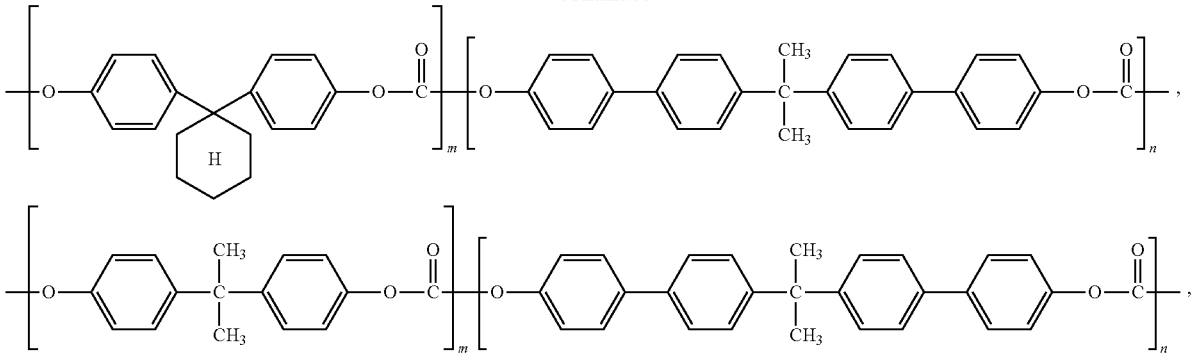

and mixtures thereof, and a fluoropolymer filler.

In yet further embodiments, there is provided an image forming apparatus comprising: an imaging member comprising a substrate, an undercoat layer disposed on the substrate, a charge generation layer disposed on the undercoat layer, and a charge transport layer disposed on the charge generation layer, wherein the charge transport layer comprises a tetraaryl polycarbonate and a fluoropolymer filler; and a charging unit comprising a charging roller disposed in contact with the surface of the imaging member to form images on the surface of the imaging member.

BRIEF DESCRIPTION OF THE DRAWINGS

For a better understanding, reference may be made to the accompanying figures.

DETAILED DESCRIPTION

Figure 1:
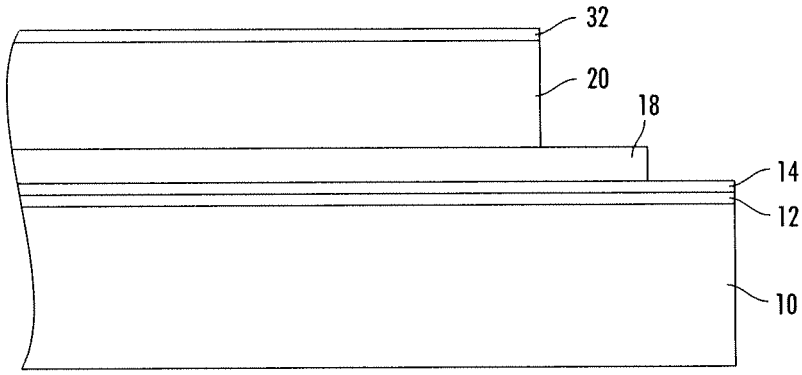
FIG. 1 is a cross-sectional view of an imaging member in a conventional drum configuration.

In the following description, reference is made to the accompanying drawings, which form a part hereof and which illustrate several embodiments. It is understood that other embodiments may be used and structural and operational changes may be made without departure from the scope of the present disclosure.

The disclosed embodiments are directed generally to an improved electrophotographic imaging member comprising a charge transport layer comprising a novel formulation of a polycarbonate binder and one or more perfluorinated fillers. In embodiments, the binder is a tetraaryl polycarbonate and the perfluorinated fillers are selected from a fluoropolymer group consisting of polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), a copolymer of tetrafluoroethylene, hexafluoropropylene and vinylidene fluoride, and mixtures thereof. In the present embodiments, the perfluorinated fillers are incorporated into a CTL formulation comprising the tetraaryl polycarbonate. The novel CTL formulation results in a CTL exhibiting extended service life and substantially reduced wear rates.

In the present embodiments, there is also provided an image forming apparatus comprising: a) an imaging member comprising the novel charge transport layer and having a charge retentive-surface for developing an electrostatic latent image thereon; and b) a charging unit comprising a charging roller disposed in contact with the surface of the imaging member to form an image on the surface of the imaging member.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

FIG. 1 is an exemplary embodiment of a multilayered electrophotographic imaging member or photoreceptor having a drum configuration. The substrate may further be in a cylinder configuration. As can be seen, the exemplary imaging member includes a rigid support substrate 10, an electrically conductive ground plane 12, an undercoat layer 14, a charge generation layer 18 and a charge transport layer 20. An overcoat layer 32 disposed on the charge transport layer may also be included. The rigid substrate may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The substrate may also comprise a material selected from the group consisting of a metal, a polymer, a glass, a ceramic, and wood.

Figure 2:
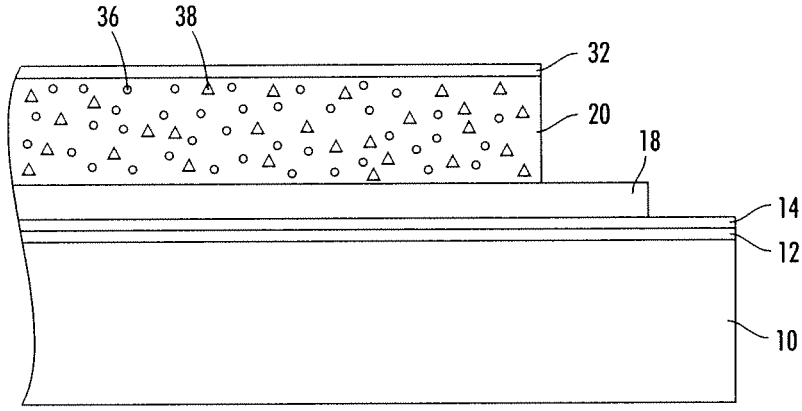
FIG. 2 is a cross-sectional view of an imaging member in a drum configuration according to the present embodiments.

The charge generation layer 18 and the charge transport layer 20 forms an imaging layer described here as two separate layers. In an alternative to what is shown in the figure, the charge generation layer may also be disposed on top of the charge transport layer. It will be appreciated that the functional components of these layers may alternatively be combined into a single layer. In the present embodiments, the charge transport layer 20 comprises a tetraaryl polycarbonate 36 and fluoropolymer filler 38, as shown in FIG. 2.

As discussed above, an electrophotographic imaging member generally comprises at least a substrate layer, an imaging layer disposed on the substrate and an overcoat layer disposed on the imaging layer. In further embodiments, the imaging layer comprises a charge generation layer disposed on the substrate and the charge transport layer disposed on the charge generation layer. In other embodiments, an undercoat layer may be included and is generally located between the substrate and the imaging layer, although additional layers may be present and located between these layers. The imaging member may also include an anti-curl back coating layer in certain embodiments. The imaging member can be employed in the imaging process of electrophotography, where the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing charged particles of same or opposite polarity on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 2, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

An exemplary substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl)gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino) titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The hole blocking layers that contain metal oxides such as zinc oxide, titanium oxide, or tin oxide, may be thicker, for example, having a thickness up to about 25 micrometers. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

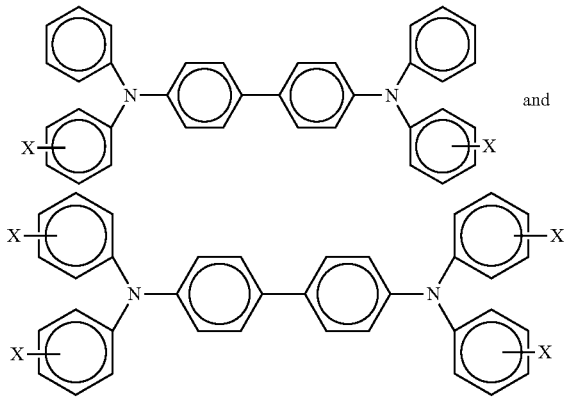

and wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

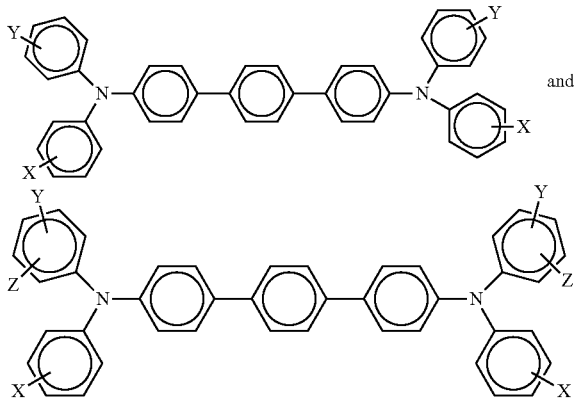

and wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis- (2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

In the present embodiments, the binder material used in the charge transport layer is a tetraaryl polycarbonate 36 instead of more conventional binders such as poly(4,4'-dihydroxy-diphenyl-1,1-cyclohexane carbonate) (PCZ-400). In further embodiments, the tetraaryl polycarbonate is a copolymer selected from the group consisting of

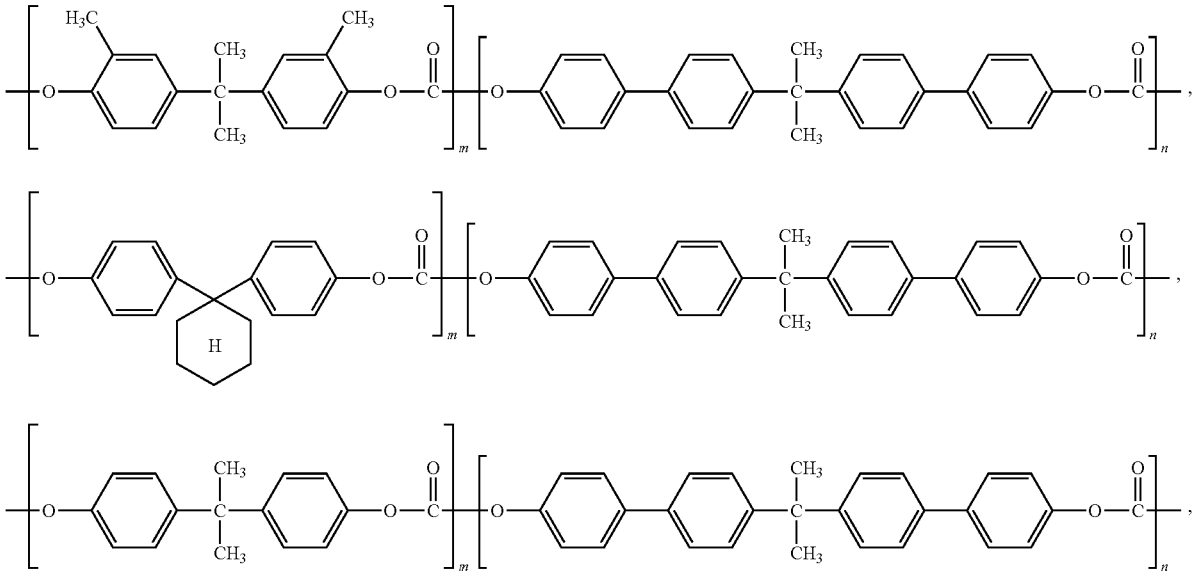

and the like, and mixtures thereof, wherein m is from about 30 to about 99 mole percent, or from about 45 to about 95 mole percent, or from about 60 to about 90 mole percent, and n is from about 1 to about 70 mole percent, or from about 5 to about 55 mole percent, or from about 10 to about 40 mole percent.

In specific embodiments, the tetraaryl polycarbonate copolymer 36 is one of the following

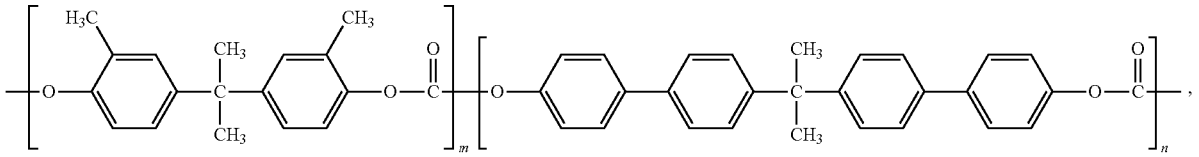

wherein m=80 mol percent, n=20 mol percent, and viscosity average molecular weight=62,300 (designated C80PPA20),

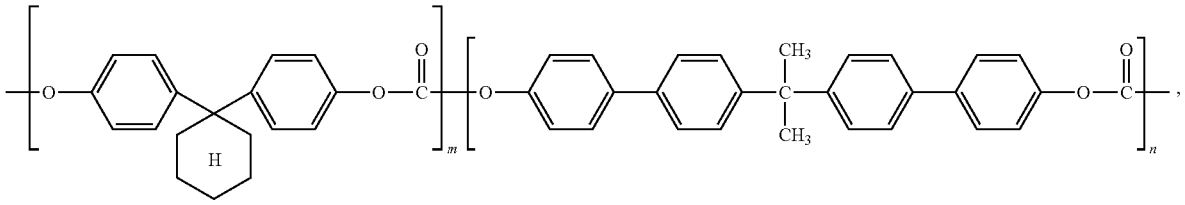

wherein m=80 mol percent, n=20 mol percent, and viscosity average molecular weight=64,600 (designated Z80PPA20), or m=75 mol percent, n=25 mol percent, and viscosity average molecular weight=55,300 (designated Z75PPA25), or m=70 mol percent, n=30 mol percent, and viscosity average molecular weight=56,900 (designated Z70PPA30), and

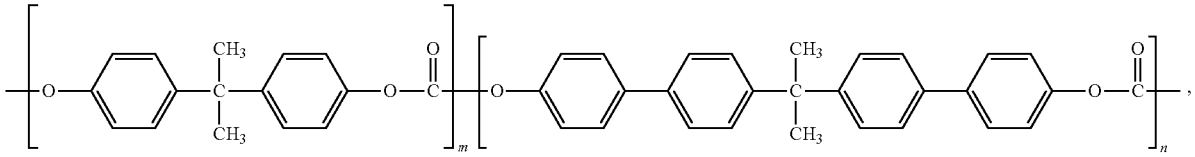

wherein m=80 mol percent, n=20 mol percent, and viscosity average molecular weight=62,600 (designated A80PPA20), or m=75 mol percent, n=25 mol percent, and viscosity average molecular weight=52,500 (designated A75PPA25), or m=70 mol percent, n=30 mol percent, and viscosity average molecular weight=54,800 (designated A70PPA30), all obtained from Mitsbushi Gas Chemical Company (Tokyo, Japan). Both the m/n ratio and molecular weights, however, can be varied for optimized properties. In embodiments, the tetraaryl polycarbonate is present in the charge transport layer in an amount of from about 30 to about 80 percent, or from about 40 to about 70 percent, or from about 50 to about 65 percent by weight of the total charge transport layer.

The charge transport layer of the present embodiments further include a fluoropolymer filler 38 incorporated into the tetraaryl polycarbonate comprising charge transport layer. The filler includes polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), and a copolymer of tetrafluoroethylene, hexafluoropropylene and vinylidene fluoride, and the like, and mixtures thereof. In embodiments, the fluoropolymer filler is present in the charge transport layer in an amount of from about 1 to about 30 percent, or from about 3 to about 25 percent, or from about 5 to about 20 percent by weight of the total charge transport layer.

In further embodiments, the weight ratio of the tetraaryl polycarbonate 36 to the fluoropolymer filler 38 is from about 2:1 to about 20:1, or from about 3:1 to about 15:1, or from about 4:1 to about 10:1.

The charge transport layer of the present embodiments exhibited nominal (photo-induced discharge curves) PIDC and cyclic stability, and about 20% improved BCR wear resistance when compared to a conventional photoreceptor comprising the current PCZ/PTFE charge transport layer. In embodiments, the photoreceptor exhibits up to a 50% wear rate reduction. In further embodiments, the photoreceptor exhibits from about 15% to about 50% wear rate reduction, or from about 15% to about 20% wear rate reduction. Specifically, in embodiments, the photoreceptor has a wear rate of from about 30 to about 60 nm/kcycle, or from about 35 to about 55 nm/kcycle, or from about 40 to about 50 nm/kcycle.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate)methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Adhesive Layer

An optional separate adhesive interface layer may be provided in certain configurations, such as for example, in flexible web configurations. In the embodiment illustrated in FIG. 1, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 micrometers, or no more than about 900 micrometers after drying. In embodiments, the dried thickness is from about 0.03 micrometers to about 1 micrometer.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

The Anti-Curl Back Coating Layer

The anti-curl back coating 1 may comprise organic polymers or inorganic polymers that are electrically insulating or slightly semi-conductive. The anti-curl back coating provides flatness and/or abrasion resistance.

Anti-curl back coating 1 may be formed at the back side of the substrate 2, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

Fabrication of Inventive Charge Transport Layers

Charge transport layers having the formulations C80PPA20/N,N'-diphenyl-N,N-bis(3-methylphenyl)-1,1'-biphenyl-4,4'-diamine (mTBD)/butylated hydroxytoluene (BHT)=57/43/1 and Z80PPA20/mTBD/BHT=57/43/1 were prepared.

A polytetrafluoroethylene filler (POLYFLON® L2) was incorporated into the tetraaryl polycarbonate copolymer charge transport layers. Specifically, the copolymer C80PPA20 of the above first charge transport layer and Z80PPA20 of the above second charge transport layer were used. About 8 wt % of PTFE POLYFLON® L2 was incorporated into the C80PPA20/mTBD/BHT=57/43/1 and Z80PPA20/mTBD/BHT=57/43/1, respectively with the aid of GF-400 as the polymeric dispersant (3 wt % versus the weight of the PTFE filler) using CaviPro 300.

The inventive charge transport layer were incorporated into two drum photoreceptor devices having the following structures: a 3-component undercoat layer, a hydroxyl gallium phthalocyanine (V) charge generation layer and the prepared charge transport layers (32 μm).

More specifically, the 3-component undercoat layer was prepared as follows: Zirconium acetylacetonate tributoxide (35.5 parts), .gamma.-aminopropyltriethoxysilane (4.8 parts) and poly(vinyl butyral) BM-S (2.5 parts) were dissolved in n-butanol (52.2 parts). The coating solution was coated via a ring coater, and the layer was pre-heated at 59° C. for 13 minutes, humidified at 58° C. (dew point=54° C.) for 17 minutes, and then dried at 135° C. for 8 minutes. The thickness of the undercoat layer was approximately 1.2 microns.

A 0.2 micron thick charge generation layer was subsequently coated on top of the above generated undercoat layer from a dispersion of Type V hydroxyl gallium phthalocyanine (3.0 grams) and a vinyl chloride/vinyl acetate copolymer, VMCH (Mn=27,000, about 86 weight percent of vinyl chloride, about 13 weight percent of vinyl acetate and about 1 weight percent of maleic acid available from Dow Chemical (2 grams), in 95 grams of n-butyl acetate.

Example 2

Fabrication of Control Charge Transport Layers

A control device was made according to the above except that the control device contained a charge transport layer (CTL) made of PCZ-400/PTFE.

Figure 3A:
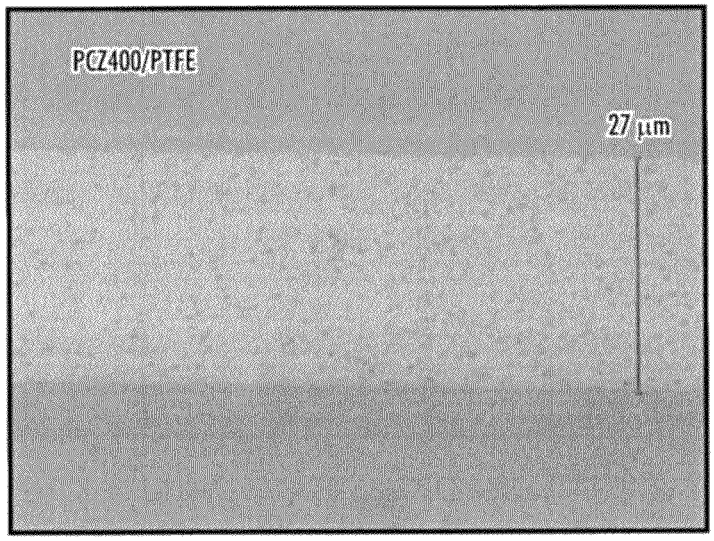
FIGS. 3A and 3B are images showing comparable dispersion quality between a control CTL (FIG. 3A) and a CTL made according to the present embodiments (FIG. 3B).
Figure 3B:
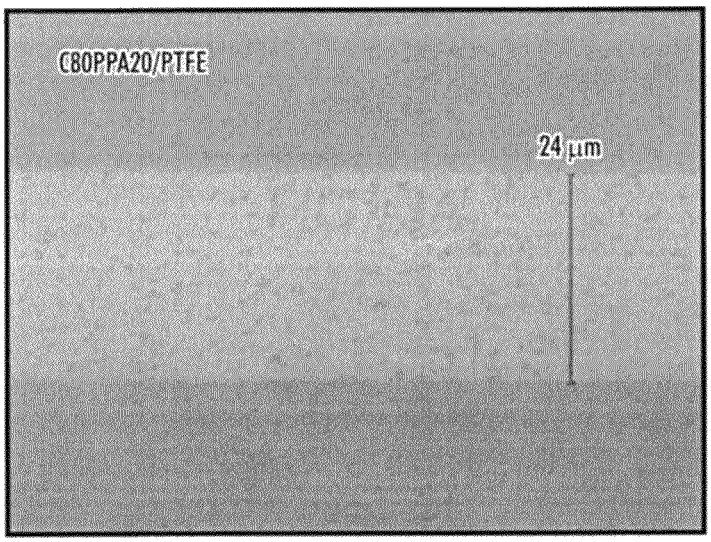

In comparison, to the inventive layers, 8 wt % PTFE was incorporated into the control PCZ-400/mTBD/BHT=57/43/1 using the same milling procedure. The LM images of FIGS. 3A and 3B showed comparable dispersion quality between the control PCZ-400/mTBD/BHT/PTFE=57/43/1/8 and the disclosed C80PPA20/mTBD/BHT/PTFE=57/43/1/8.

Testing

Evaluation of Devices

Wear tests of the photoconductors of the disclosed example and the control example were performed using an in house wear test fixture (biased charging roll, and BCR charging with peak to peak voltage of 1.8 kilovolts). The total thickness of each photoconductor was measured via Permascope before each wear test was initiated. Then the photoconductors were separately placed into the wear fixture for 100 kilocycles. The total photoconductor thickness was measured again with the Permascope, and the difference in thickness was used to calculate wear rate (nanometers/kilocycle) of the photoconductors. The smaller the wear rate, the more wear resistant was the photoconductor.

The Wear Rate of the Disclosed Example (C80PPA20/mTBD/BHT/PTFE=57/43/1/8) was about 47 nm/kcycle; and the wear rate of the control example (PCZ-400/mTBD/BHT/PTFE=57/43/1/8) was about 61 nm/kcycle. Wear fixture tests demonstrated about 20% wear reduction for the inventive photoreceptors over the control photoreceptor.

In summary, the inventive charge transport layers provide an unexpected and substantially improved alternative to the current charge transport layers by providing reduced wear and extended service life.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising a substrate;

an undercoat layer disposed on the substrate;

a charge generation layer disposed on the substrate; and a charge transport layer disposed on the charge generation layer, wherein the charge transport layer comprises a polycarbonate comprising a 4,4'-(propane-2,2-diyl) bis (biphenyl) repeating unit and a fluoropolymer filler.

2. The imaging member of claim 1, wherein the polycarbonate is a copolymer of structure:

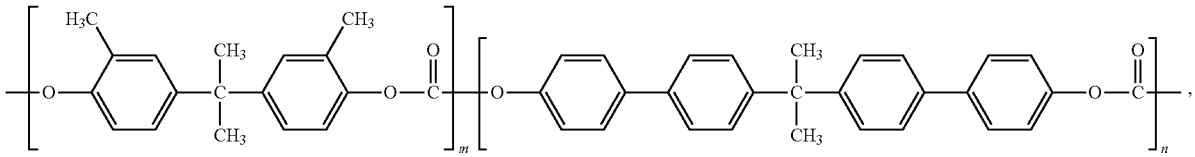

wherein m =80 mol percent, n =20 mol percent.

3. The imaging member of claim 1, wherein the fluoropolymer filler is selected from the group consisting of polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), a copolymer of tetrafluoroethylene, hexafluoropropylene and vinylidene fluoride, and mixtures thereof.

4. The imaging member of claim 1, wherein the polycarbonate is present in an amount of from about 30 to about 80 percent by weight of the total weight of the charge transport layer.

5. The imaging member of claim 4, wherein the polycarbonate is present in an amount of from about 40 to about 70 percent by weight of the total weight of the charge transport layer.

6. The imaging member of claim 1, wherein the fluoropolymer filler is present in an amount of from about 1 to about 30 percent by weight of the total weight of the charge transport layer.

7. The imaging member of claim 6, wherein the fluoropolymer filler is present in an amount of from about 3 to about 25 percent by weight of the total weight of the charge transport layer.

8. The imaging member of claim 1, wherein a weight ratio of the polycarbonate to the fluoropolymer filler is from about 2:1 to about 20:1.

9. The imaging member of claim 8, wherein a weight ratio of the polycarbonate to the fluoropolymer filler is from about 3:1 to about 15:1.

10. The imaging member of claim 1, wherein the polycarbonate is a copolymer of structure:

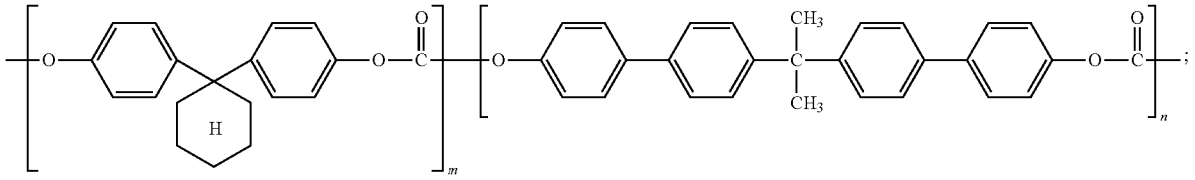

wherein m =80 mol percent, n =20 mol percent; or m =75 mol percent, n =25 mol percent, or m =70 mol percent, n =30 mol percent.

11. The imaging member of claim 1, wherein the polycarbonate is a copolymer of structure:

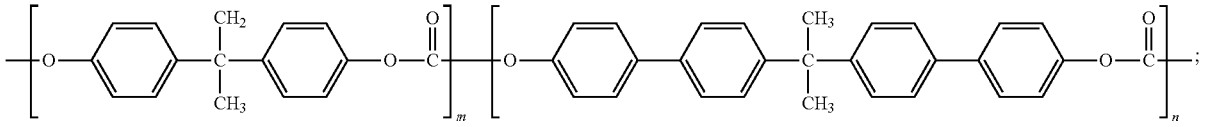

wherein m =80 mol percent, n =20 mol percent; or m =75 mol percent, n =25 mol percent, or m =70 mol percent, n =30 mol percent.

12. An imaging member comprising a substrate;

an undercoat layer disposed on the substrate;

a charge generation layer disposed on the substrate; and a charge transport layer disposed on the charge generation layer, wherein the charge transport layer comprises a polycarbonate copolymer selected from the group consisting of:

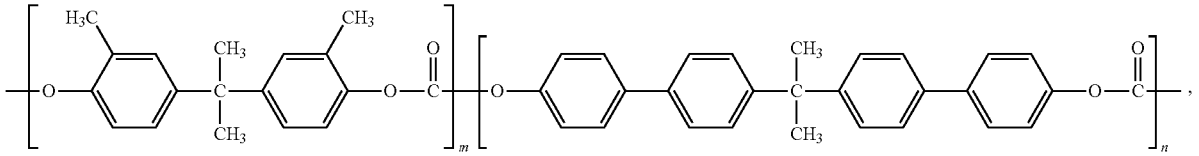

wherein m =80 mol percent, n =20 mol percent;

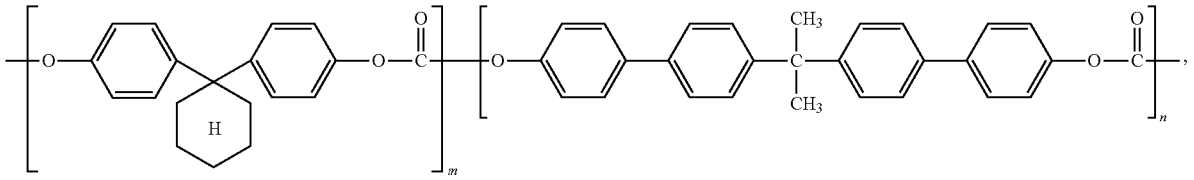

wherein m =80 mol percent, n =20 mol percent; or m =75 mol percent, n =25 mol percent, or m =70 mol percent, n =30 mol percent;

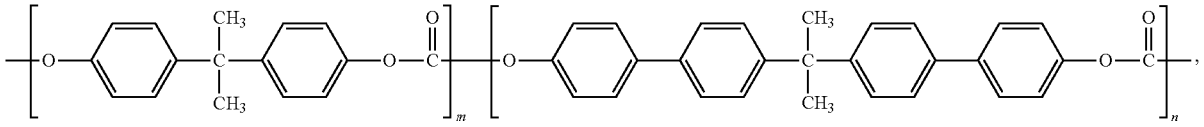

wherein m =80 mol percent, n =20 mol percent; or m =75 mol percent, n =25 mol percent, or m =70 mol percent, n =30 mol percent;

and mixtures thereof, and a fluoropolymer filler.

13. The imaging member of claim 12, wherein the charge transport layer further comprises a charge transport component and an antioxidant.

14. The imaging member of claim 11, wherein the antioxidant is selected from the group consisting of butylated hydroxytoluene, tetrakis methylene(3,5-di-tert-butyl-4-hydroxy hydrocinnamate) methane, and mixtures thereof.

15. The imaging member of claim 12, wherein the charge transport component is selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl ]-4,4"-diamine, N,N'-bis(4-butylphenyl)-N,N'-di-m-tolyl- [p-terphenyl]-4,4"-diamine, N,N'-bis(4-butylphenyl)-N,N'-di-o-tolyl- [p-terphenyl]-4,4"-diamine, and mixtures thereof.

16. The imaging member of claim 12, wherein the fluoropolymer filler is selected from the group consisting of polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), a copolymer of tetrafluoroethylene, hexafluoropropylene and vinylidene fluoride, and mixtures thereof.

17. An image forming apparatus comprising:

a) an imaging member comprising a substrate, an undercoat layer disposed on the substrate, a charge generation layer disposed on the undercoat layer, and a charge transport layer disposed on the charge generation layer, wherein the charge transport layer comprises a polycarbonate comprising a 4,4'-(propane-2,2-diyl) bis(biphenyl) repeating unit and a fluoropolymer filler; and b) a charging unit comprising a charging roller disposed in contact with the surface of the imaging member to form images on the surface of the imaging member.

18. The image forming apparatus of claim 17, wherein the polycarbonate is a copolymer selected from the group consisting of:

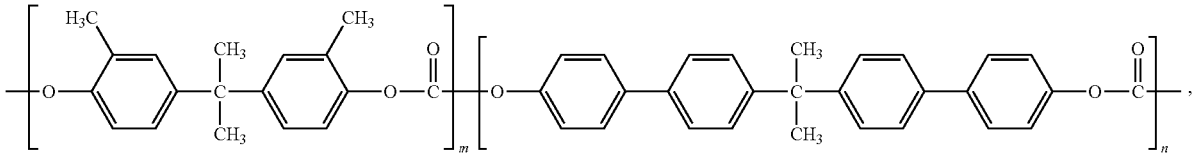

wherein m =80 mol percent, n =20 mol percent;

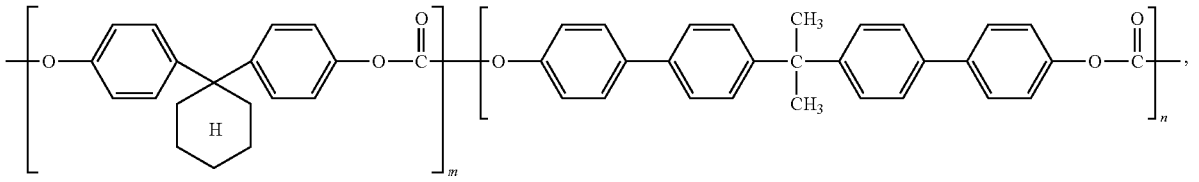

wherein m =80 mol percent, n =20 mol percent; or m =75 mol percent, n =25 mol percent, or m =70 mol percent, n =30 mol percent;

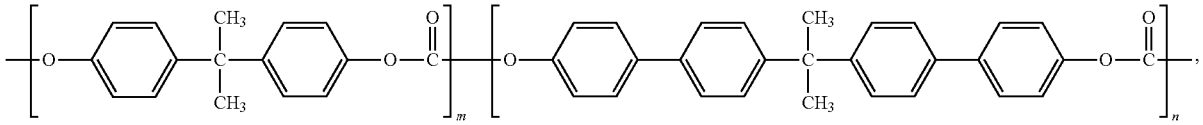

wherein m =80 mol percent, n =20 mol percent; or m =75 mol percent, n =25 mol percent, or m =70 mol percent, n =30 mol percent;

and mixtures thereof.

19. The image forming apparatus of claim 17, wherein the fluoropolymer filler is selected from the group consisting of polytetrafluoroethylene, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), a copolymer of tetrafluoroethylene, hexafluoropropylene and vinylidene fluoride, and mixtures thereof.

20. The image forming apparatus of claim 17, wherein the polycarbonate is present in an amount of from about 40 to about 65 percent by weight of the total weight of the charge transport layer, and the fluoropolymer filler is present in an amount of from about 5 to about 10 percent by weight of the total weight of the charge transport layer.

* * * * *